US007445328B2

(12) United States Patent
Sawai

(10) Patent No.: US 7,445,328 B2
(45) Date of Patent: Nov. 4, 2008

(54) IMAGE FORMING APPARATUS

(75) Inventor: Kunio Sawai, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 402 days.

(21) Appl. No.: 11/189,987

(22) Filed: Jul. 27, 2005

(65) Prior Publication Data

US 2006/0028525 A1 Feb. 9, 2006

(30) Foreign Application Priority Data

Aug. 3, 2004 (JP) ..... 2004-227259

(51) Int. Cl.
*B41J 2/01* (2006.01)

(52) U.S. Cl. ..... 347/104; 347/101

(58) Field of Classification Search ..... 347/104–108, 347/171, 101, 103
See application file for complete search history.

(56) References Cited

U.S. PATENT DOCUMENTS 5,686,950 A * 11/1997 Hirakue ..... 347/104
5,793,399 A * 8/1998 Kawakami et al. ..... 347/104
2004/0179045 A1* 9/2004 Awai et al. ..... 347/1

FOREIGN PATENT DOCUMENTS

| | | |
|---|---|---|
| JP | 63-53062 | 4/1988 |
| JP | 05-32856 U | 4/1993 |
| JP | 07-276735 A | 10/1995 |
| JP | 09-211593 | 8/1997 |
| JP | 2001-208162 A | 8/2001 |

* cited by examiner

*Primary Examiner*—Manish S Shah
(74) *Attorney, Agent, or Firm*—Global IP Counselors, LLP

(57) ABSTRACT

An image forming apparatus has a chassis, a roller rotatably supported in the chassis, a motor for driving the roller in either of first and second rotational directions, a motive gear that receives driving force from the motor, a driven gear that meshes with the motive gear, and a pivot arm that is pivotably mounted on the motive gear and has an axle that rotatably supports the driven gear via a coil spring. The inner peripheral portion of the coil spring engages a first holder formed on the driven gear, while the outer peripheral portion of the coil spring engages a second holder formed on the pivot arm. It is possible to use a coil spring to pivot a pivot arm without increasing the number of components or the time required for assembly.

8 Claims, 7 Drawing Sheets

IMAGE FORMING APPARATUS

BACKGROUND OF THE INVENTION

1. Field of the Invention

The present invention relates to an image forming apparatus. More specifically, the present invention relates to an image forming apparatus having a gear and a coil spring.

2. Background Information

Heat transfer printers are known as an example of a conventional image forming apparatus. Such heat transfer printer generally has a feed roller and a press roller, between which a paper is to be conveyed. The feed roller is rotated by a feed roller gear, to which rotational torque is transmitted from a motor. The feed roller gear further transmits the rotational torque to an oscillating gear via a pivot arm.

An example of the feed roller gear 113 and the oscillating gear 118 are shown in FIGS. 10-13. Also, as shown in FIGS. 10 through 13, the feed roller gear 113 is provided with a feed roller gear portion 113*a* for meshing with a small gear 118*a* of the oscillating gear 118, and a D-shaped mounting hole 113*b* into which a gear insertion unit 102*a* of the feed roller 102 is inserted.

As shown in FIG. 13, the pivot arm 114 is provided with an oscillating gear support axle 114*a* for pivotably supporting an oscillating gear bearing 118*c* of the oscillating gear 118; a pivoting arm hole 114*b* into which the feed roller 102 is rotatably inserted; and a boss unit 114*c* (see FIG. 10) for controlling the amount of pivoting of the pivot arm 114 by interlocking with a control element. A groove for mounting a retaining washer 119 is provided at the top of the oscillating gear support axle 114*a* of the pivot arm 114.

Also, as shown in FIG. 13, a compressed coil spring 115 is inserted between the pivot arm 114 and the oscillating gear 118 to hinder the pivoting of the oscillating gear 118 by pressing the pivot arm 114 and the oscillating gear 118 in the thrust direction (axial direction) via felts 116 and 117. The oscillating gear 118 is moved in the direction of rotation of the feed roller gear 113 during the rotation of the feed roller gear 113. Accordingly, the pivot arm 114 on which the oscillating gear 118 is mounted therefore pivots as well.

Also, as shown in FIG. 12, the felts 116 and 117 are provided for preventing the pivot arm 114 and the oscillating gear 118 from coming into direct contact with the compressed coil spring 115. It is thereby possible to prevent abrasions on the top surface of the pivot arm 114 and the bottom surface of the oscillating gear 118.

Also, as shown in FIG. 13, the oscillating gear 118 is provided with a small gear 118*a* for meshing with the feed roller gear 113, a large gear 118*b* for meshing with still another gear, and an oscillating gear bearing 118*c* into which an oscillating gear support axle 114*a* of the pivot arm 114 is inserted. The retaining washer 119 for preventing the oscillating gear 118 from falling out is mounted on the distal end of the oscillating gear support axle 114*a* of the pivot arm 114.

Since the pivot arm 114 shown in FIGS. 10 through 13 is configured to pivot by the resistance from the axial (thrust-wise) (frictional force) load of the compressed coil spring 115, the retaining washer 119 is needed for preventing the oscillating gear 118 from coming loose. Furthermore, the felts 116 and 117 are needed to prevent abrasions on the pivot arm 114 and the oscillating gear 118. As a result, the number of components increases. Furthermore, there is a need form a groove in the oscillating gear support axle 114*a* of the pivot arm 114 for mounting the retaining washer 119. Thus, it takes long time to assemble this structure.

In view of the above, it will be apparent to those skilled in the art from this disclosure that there exists a need for an improved gear support structure for the image forming apparatus that overcomes the problems of the conventional art. This invention addresses this need in the art as well as other needs, which will become apparent to those skilled in the art from this disclosure.

SUMMARY OF THE INVENTION

An object of the present invention is to provide an image forming apparatus in which a pivot arm can be pivoted with a coil spring, and which requires a small number of components and short assembly time.

The image forming apparatus according to the first aspect of the present invention includes a chassis; a roller rotatably supported in the chassis; a motor configured to drive the roller in either of first and second rotational directions; a motive gear that receives driving force from the motor; a driven gear that meshes with the motive gear; and a pivot arm that is pivotably mounted on the motive gear and has an axle that rotatably supports the driven gear via a coil spring, one of inner and outer peripheral portions of the coil spring engaging a first holder formed on the driven gear with a biasing force of the coil spring, the other of the inner and outer peripheral portions of the coil spring engaging a second holder formed on the pivot arm with the biasing force of the coil spring.

In this arrangement, the driven gear is provided with a first holder that engages one of the inner and outer peripheral portions of the coil spring of in a state the contact is maintained by a pressure applied by the coil spring. Also, the pivot arm is provided with a second holder that engages the other of the inner and outer peripheral portions of the coil spring in a state in which the contact is maintained by a pressure applied by the coil spring. Accordingly, the sliding resistance in the peripheral direction is generated between the inner and outer peripheral surfaces of the coil spring and the first and second holders. As a result, the sliding resistance in the peripheral direction hinders rotation of the driven gear relative to the axle of the pivot arm. Accordingly, the pivot arm on which the driven gear is mounted can be easily pivoted as the motive gear rotates with the driven gear being moved in the direction of rotation of the motive gear.

Thus, since the pivot arm can be pivoted by the sliding resistance in the peripheral direction, there are no problems such as the driven gear separating in the axial direction, unlike in a conventional structure in which the pivot arm is pivoted while hindering the rotation of the driven gear with the thrust-wise (axial) load of the compressed coil spring. Therefore, there is no need to provide a retaining washer in the axial direction or to provide a groove for mounting the retaining washer. As a result, the number of components can be proportionately reduced and the time required for assembly can be reduced.

In the image forming apparatus according to the second aspect of the present invention, the first holder of the driven gear includes a cylindrical portion with a circular outer peripheral portion that engages the inner peripheral portion of the coil spring, and the second holder of the pivot arm includes a concave portion with a circular inner peripheral portion that engages the outer peripheral portion of the coil spring.

With such a configuration, the diameter of the coil spring increases when the driven gear rotates in the direction opposite from the winding direction of the coil spring relative to the axle of the pivot arm, and the pressure between the circular outer peripheral surface of the cylindrical portion of the first holder of the driven gear and the inner peripheral surface of the coil spring is therefore reduced. The sliding resistance in the peripheral direction between the driven gear and the coil spring can thereby be reduced when the driven gear rotates in the direction opposite from the winding direction of the coil spring relative to the axle of the pivot arm, and the driven gear can therefore slide smoothly against the coil spring.

Conversely, when the driven gear rotates in the winding direction of the coil spring in relation to the pivot arm, the diameter of the coil spring decreases and the pressure between the circular inner peripheral surface of the concave portion of the second holder of the pivot arm and the outer peripheral surface of the coil spring is therefore reduced. The sliding resistance in the peripheral direction between the pivot arm and the coil spring can thereby be reduced when the driven gear rotates in the winding direction of the coil spring relative to the axle of the pivot arm, and the coil spring can therefore slide smoothly against the second holder of the pivot arm. As a result, the driven gear can also smoothly rotate integrally with the coil spring relative to the axle of the pivot arm.

In the image forming apparatus according to the third aspect of the present invention, the concave portion of the pivot arm has a shape of a groove. With such a configuration, the outer peripheral surface of the coil spring can easily be brought into contact with the inner peripheral surface of the groove with a pressure being applied by the coil spring by engaging the coil spring with the inner peripheral surface of the groove. Thus, the sliding resistance in the peripheral direction can therefore be easily ensured.

In the image forming apparatus according to the fourth aspect of the present invention, a winding gear is further included. The pivot arm being configured to be pivoted toward the winding gear when the motor drives the roller in the first rotational direction. The driven gear being configured to mesh with the winding gear when the motive gear rotates in the first rotational direction. With such a configuration, the ink sheet winding gear can easily be rotated by the driven gear only when the motive gear rotates in a second rotational direction.

In the image forming apparatus according to the fifth aspect of the present invention, the first holder of the driven gear includes a concave portion with a circular inner peripheral portion that engages the outer peripheral portion of the coil spring, and the second holder of the pivot arm includes a cylindrical portion with a circular outer peripheral portion that engages the inner peripheral portion of the coil spring.

In the image forming apparatus according to the sixth aspect of the present invention, the roller is a feed roller adapted to convey paper in a paper supply direction when the motor rotates the feed roller in the second rotational direction, and in a paper ejection direction when the motor rotates the feed roller in the first rotational direction.

In the image forming apparatus according to the seventh aspect of the present invention, the image forming apparatus is a heat transfer printer.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Referring initially to FIGS. 1-9, an image forming apparatus in accordance with a first embodiment of the present invention is described.

Figure 1:
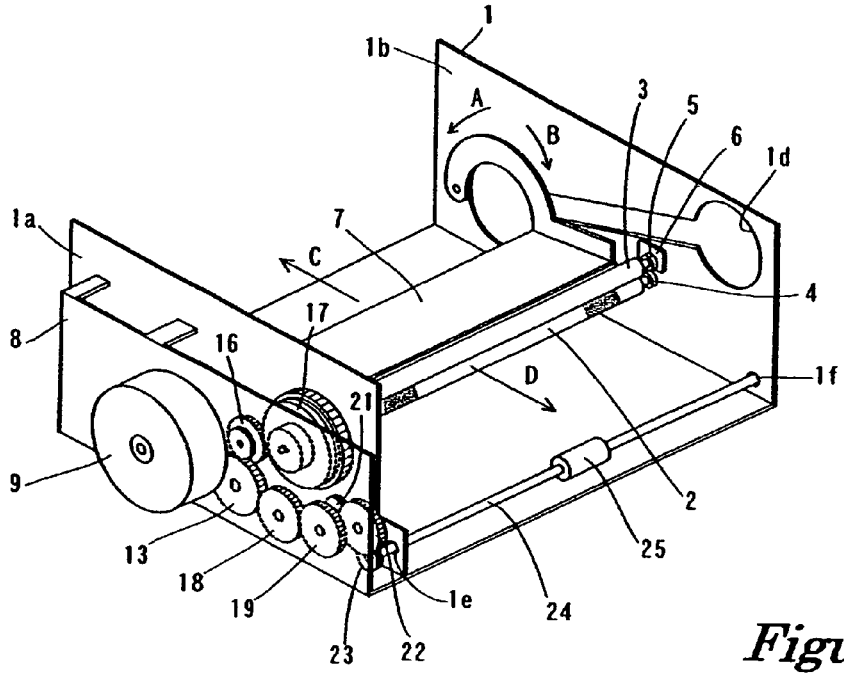
FIG. 1 is a perspective view of an entire structure of a heat transfer printer according to the first embodiment of the present invention.
Figure 2:
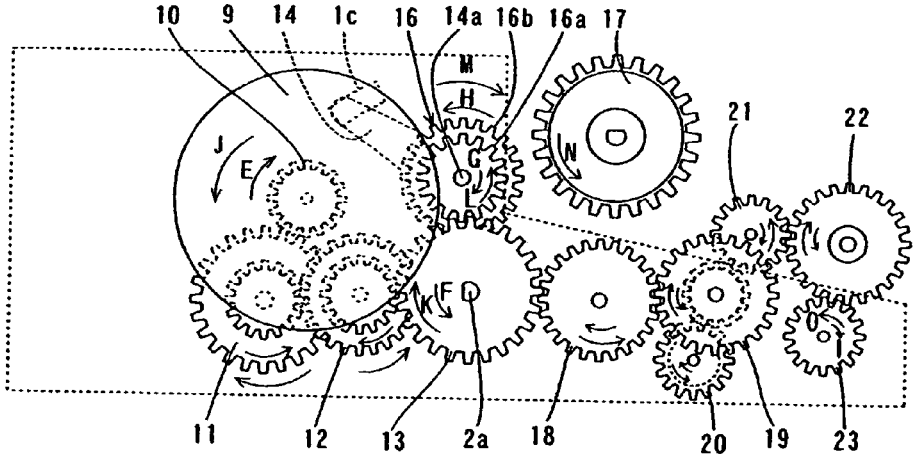
FIG. 2 is a schematic front view of the motor and gears in the heat transfer printer according to the first embodiment shown in FIG. 1.
Figure 3:
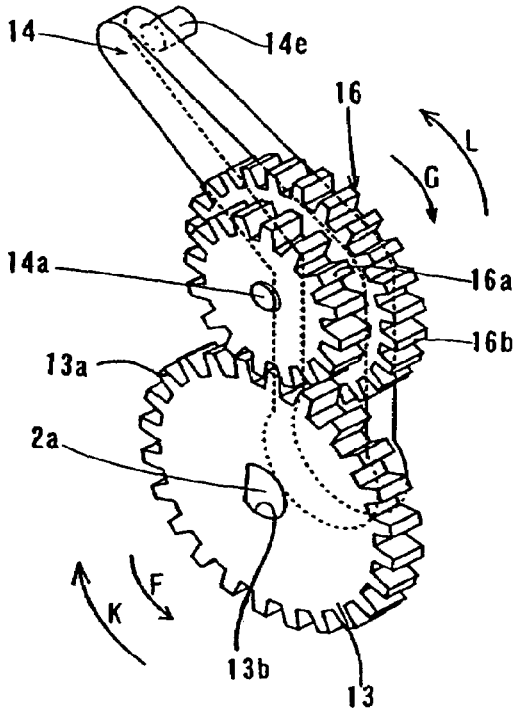
FIG. 3 is a perspective view of the feed roller gear, the oscillating gear, and the pivot arm of the heat transfer printer according to the first embodiment shown in FIG. 1.
Figure 4:
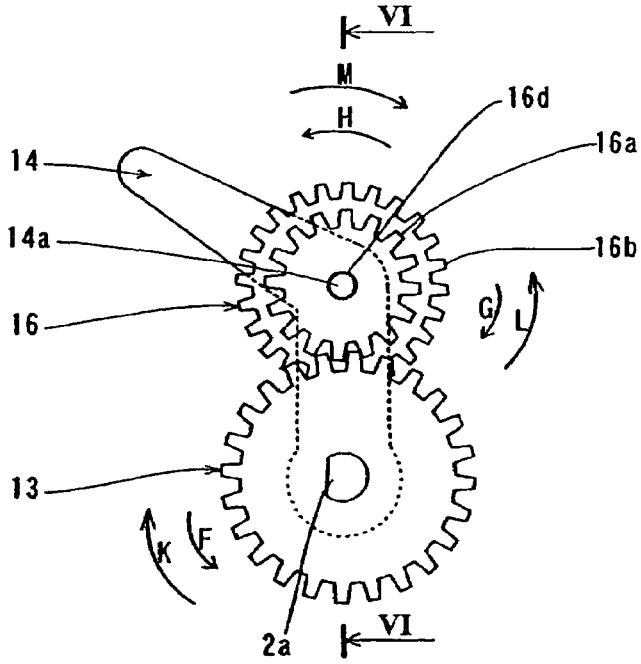
FIG. 4 is a front view of the feed roller gear, the oscillating gear, and the pivot arm of the heat transfer printer according to the first embodiment shown in FIG. 1.
Figure 5:
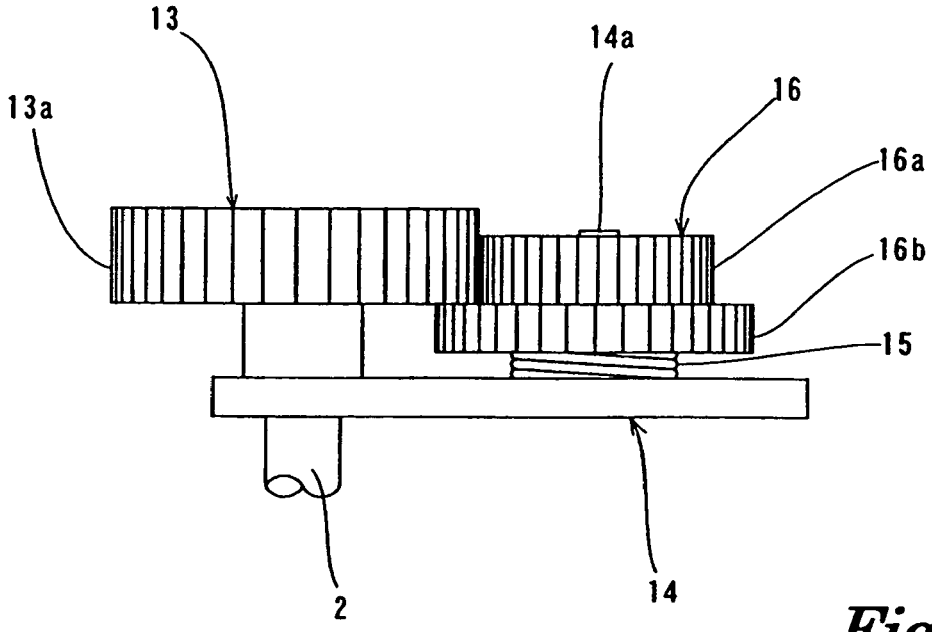
FIG. 5 is a side view of the feed roller gear, the oscillating gear, and the pivot arm of the heat transfer printer according to the first embodiment shown in FIG. 1.
Figure 6:
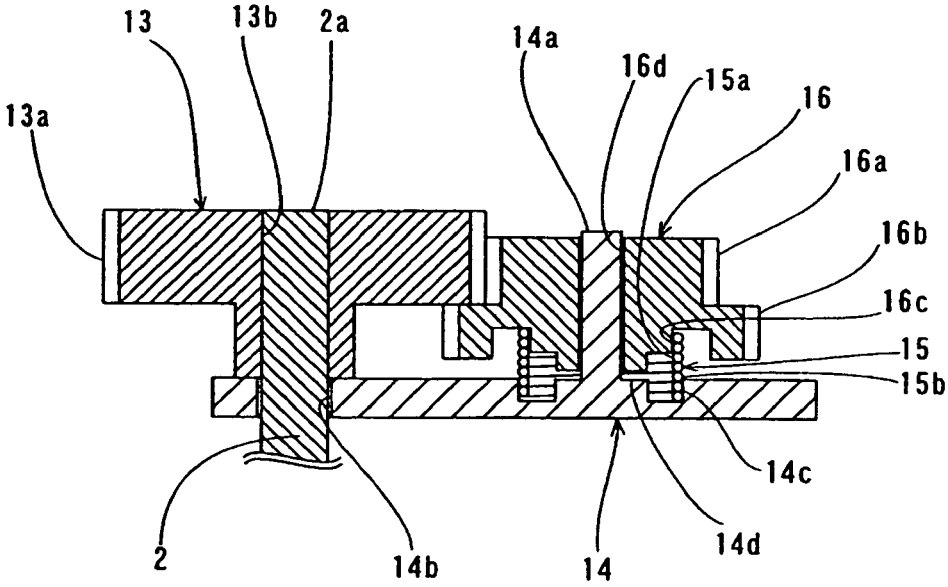
FIG. 6 is a cross-sectional view of the feed roller gear, the oscillating gear, and the pivot arm of the heat transfer printer according to the first embodiment shown in FIG. 1, viewed along the line VI-VI in FIG. 4.

FIG. 1 is a perspective view showing the general structure of a heat transfer printer according to the first embodiment of the present invention. FIG. 2 is a front view showing the motor and gears in the heat transfer printer according to the first embodiment shown in FIG. 1. FIGS. 3 through 8 are diagrams illustrating the details of the structure of the heat transfer printer shown in FIG. 1. The structure of the heat transfer printer according to the first embodiment of the present invention will be described with reference to FIGS. 1 through 8. In the present embodiment, an example will be described in which the present invention is applied to a heat transfer printer as an example of the image forming apparatus.

Figure 7:
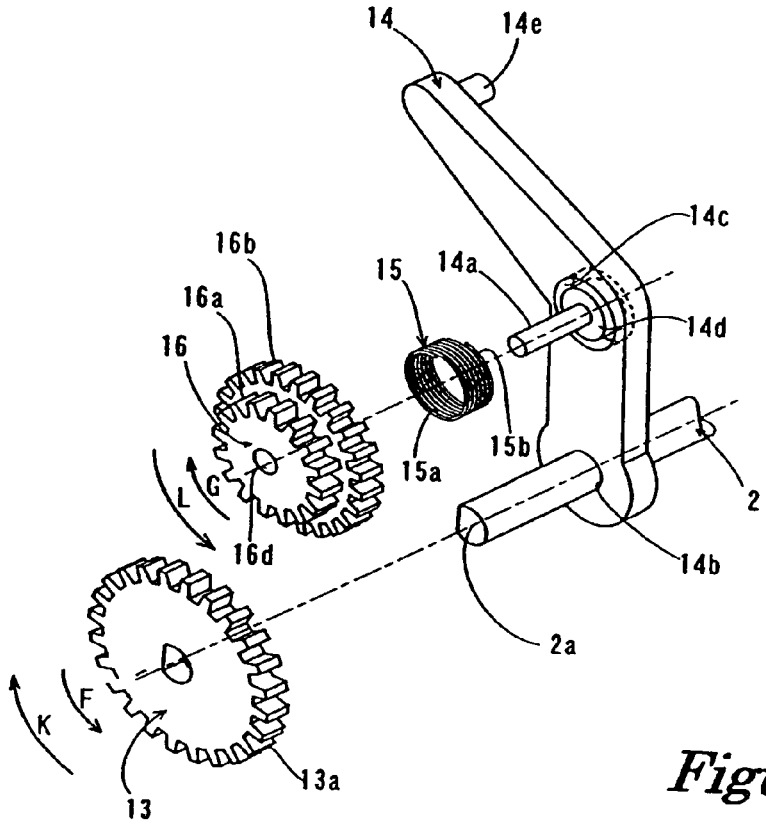
FIG. 7 is an exploded perspective view of the feed roller gear, the oscillating gear, the coil spring, and the pivot arm of the heat transfer printer according to the first embodiment shown in FIG. 1.

As shown in FIGS. 1, 2, and 7, the heat transfer printer according to the first embodiment of the present invention includes a metal chassis 1 in the shape of a U with a first side surface 1*a* and a second side surface 1*b*; a feed roller 2 for feeding paper; a metal press roller 3 for contacting the feed roller 2 with a predetermined amount of pressure; feed roller bearings 4 for rotatably supporting both ends of the feed roller 2; press roller bearings 5 for rotatably supporting both ends of the press roller 3; a metal bearing support plate 6 for supporting the press roller bearings 5; a thermal head 7 for printing; a motor bracket 8; a motor 9 mounted on the motor bracket 8; a motor gear 10 (see FIG. 2) mounted on the motor 9; intermediate gears 11 and 12, a feed roller gear 13 for meshing with the intermediate gear 12; a resinous pivot arm 14 that is pivotably mounted on the feed roller gear 13 and has an oscillating gear support axle 14*a*; a coil spring 15 (see FIG. 7) mounted on the pivot arm 14, an oscillating gear 16 that is rotatably supported on the oscillating gear support axle 14*a* of the pivot arm 14 and meshes with the feed roller gear 13; an ink sheet winding gear 17 (see FIG. 2) for meshing with the oscillating gear 16 only during printing; intermediate gears 18 through 22; a paper supply/ejection roller gear 23; a paper supply/ejection roller axle 24 (see FIG. 1) that rotates with the paper supply/ejection roller gear 23; and a rubber paper supply/ejection roller 25 mounted on the paper supply/ejection roller axle 24. The feed roller gear 13 is an example of the "motive gear" and the "feed roller gear" of the present invention. Also, the oscillating gear support axle 14*a* is an example of the "axle" in the present invention. The oscillating gear 16 is an example of the "driven gear" and the "oscillating gear" in the present invention.

The motor bracket 8 is mounted on the first side surface 1*a* of the chassis 1, as shown in FIG. 1. The first side surface 1*a* of the chassis 1 is provided with a slotted control element 1*c* (see FIG. 2) for preventing the pivoting of the pivot arm 14 from exceeding a fixed amount by pressing on the contact element 14*e* (see FIG. 3) of the pivot arm 14. As shown in FIG. 1, the second side surface 1*b* of the chassis 1 is provided with an ink sheet insertion hole 1*d* through which an ink sheet case (not shown) is to be inserted. Also, the first side surface 1*a* of the chassis 1 is provided with a paper supply/ejection roller bearing 1*e* for rotatably supporting one end of the paper supply/ejection roller axle 24. The second side surface 1*b* of the chassis 1 is provided with a paper supply/ejection roller bearing 1*f* for rotatably supporting the other end of the paper supply/ejection roller axle 24.

Also, as shown in FIG. 7, the feed roller 2 is provided with a gear insertion unit 2*a* inserted in the feed roller gear 13. Also, as shown in FIG. 1, the thermal head 7 is pivotably mounted in between the first side surface 1*a* and second side surface 1*b* of the chassis 1. A platen roller (not shown) is disposed below the thermal head 107 so as to face the thermal head 7. The motor 9, which functions as a drive source for driving the feed roller 2, the ink sheet winding member (not shown), and the paper supply/ejection roller 25, is mounted on the motor bracket 8.

In the present embodiment, as shown in FIGS. 2 through 8, the feed roller gear 13 is provided with a feed roller gear portion 13*a* for meshing with a small gear 16*a* of the oscillating gear 16, and a mounting hole 13*b* having the shape of D into which the gear insertion unit 2*a* of the feed roller 2 is inserted. The pivot arm 14 is provided with the oscillating gear support axle 14*a* for rotatably supporting the oscillating gear bearing 16*d* of the oscillating gear 16, and a pivot arm hole 14*b* into which the feed roller gear 2 is rotatably inserted. The pivot arm 14 is further provided with a holder 14*c* in the shape of a groove whose circular inner peripheral surface engages the outer peripheral surface 15*b* of the coil spring 15 to hold the coil spring 15 in a state in which the contact is maintained by a pressure being applied by the coil spring 15. In other words, the coil spring 15 is pressed into the inner peripheral surface of the holder 14*c*, and engages the holder 14*c* with the biasing force of the coil spring 15. The pivot arm 14 is still further provided with a center part 14*d* that protrudes toward the oscillating gear 16 from the bottom of the holder 14*c*, and a boss unit 14*e* (see FIG. 3) for controlling the amount by which the pivot arm 14 is caused to pivot by interlocking with the slotted control element 1*c* (see FIG. 2) of the chassis 1. The holder 14*c* is an example of the "second holder" of the present invention.

Also, the oscillating gear 16 (see FIG. 6) is provided with a small gear 16*a* that meshes with the feed roller gear 13, a large gear 16*b* that meshes with the ink sheet winding gear 17 (see FIG. 2), a holder 16*c* which is a cylindrical portion having a circular outer peripheral surface that holds the inner peripheral surface 15*a* of the coil spring 15 in a state in which the contact is maintained with a pressure being applied by the coil spring 15, and an oscillating gear bearing 16*d* through which the oscillating gear support axle 14*a* of the pivot arm 14 is inserted. In other words, the coil spring 15 is pressed into the outer peripheral surface of the holder 16*c*, and engages the holder 16*c* with the biasing force of the coil spring 15. The holder 16*c* is an example of the "first holder" in the present invention.

Also, in the present embodiment, the coil spring 15 (see FIG. 7) is wound in the counter-clockwise direction. This coil spring 15 has an inner peripheral surface 15*a* that contacts the holder 16*c* (see FIG. 8) of the oscillating gear 16 with a pressure, and an outer peripheral surface 15*b* that contacts the holder 14*c* (see FIG. 7) of the pivot arm 14 with a pressure. Sliding resistance is thereby created in the peripheral direction between the oscillating gear 16 and the pivot arm 14 via the coil spring 15, and the rotation of the oscillating gear 16 is thereby hindered. As a result, the pivot arm 14 on which the oscillating gear 16 is mounted pivots because the oscillating gear 16 is moved in the rotation direction of the feed roller gear 13 as the feed roller gear 13 rotates.

Figure 8:
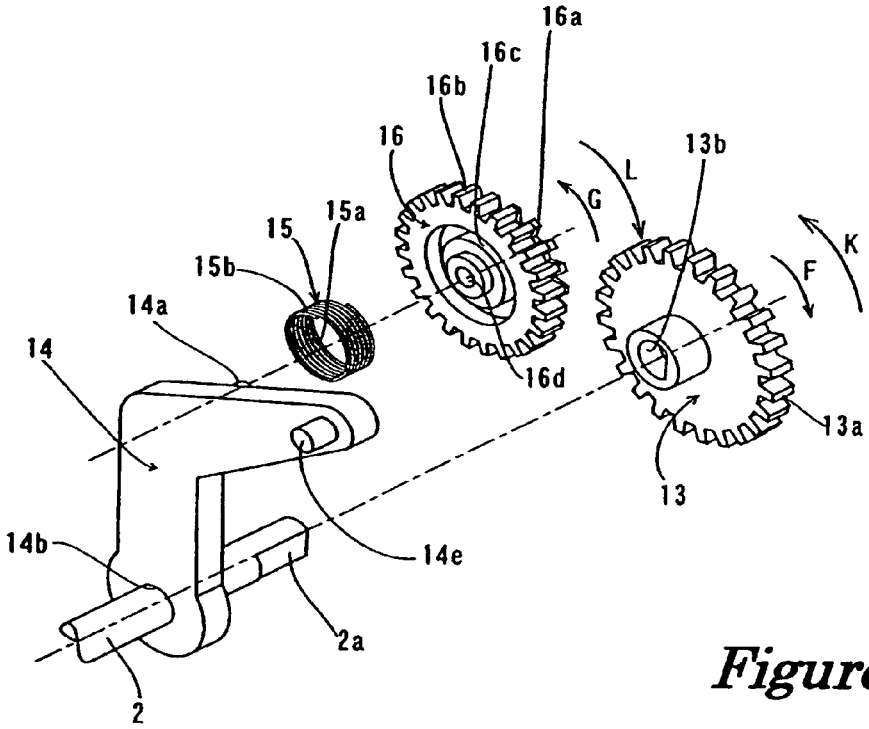
FIG. 8 is an exploded perspective view of the feed roller gear, the oscillating gear, the coil spring, and the pivot arm of the heat transfer printer according to the first embodiment shown in FIG. 1.

Also, as shown in FIGS. 7 and 8, the coil spring 15 decreases its inside and outside diameters when the oscillating gear 16 rotates clockwise (in the direction of the arrow G in FIG. 8) relative to the oscillating gear support axle 14*a* of the pivot arm 14. Therefore, there is a reduction in the sliding resistance in the peripheral direction between the holder 14*c* of the pivot arm 14 and the outer peripheral surface 15*b* of the coil spring 15. At the same time, there is an increase in the sliding resistance in the peripheral direction between the holder 16*c* of the oscillating gear 16 and the inner peripheral surface 15*a* of the coil spring 15.

Conversely, the coil spring 15 increases its inside and outside diameters when the oscillating gear 16 rotates counter-clockwise (in the direction of the arrow L in FIG. 8) relative to the oscillating gear support axle 14*a* of the pivot arm 14. Therefore, there is an increase in the sliding resistance between the holder 14*c* of the pivot arm 14 and the outer peripheral surface 15*b* of the coil spring 15, and a reduction in the sliding resistance between the holder 16*c* of the oscillating gear 16 and the inner peripheral surface 15*a* of the coil spring 15.

Next, the operation of feeding paper in the heat transfer printer during the paper supply operation will be described with reference to FIGS. 1 and 2. First, during the paper supply operation, as shown in FIGS. 1 and 2, the motor gear 10 mounted on the motor 9 rotates in the direction of the arrow E as the motor 9 is driven. As a result, the feed roller gear 13 rotates in the direction of the arrow F via the intermediate gears 11 and 12. The feed roller 2 thereby conveys paper (not shown) in the direction of the arrow C, as shown in FIG. 1. At this time, the oscillating gear 16 mounted on the pivot arm 14 is not meshed with the ink sheet winding gear 17, because the pivot arm 14 pivots in the direction of the arrow H in FIG. 2. Therefore, the ink sheet winding gear 17 does not rotate.

At this time, the thermal head 7 is pivoted in a direction away from the paper (the direction of the arrow A in FIG. 1), as shown in FIG. 1, by the drive of a motor (not shown) provided separately from the motor 9. The paper supply/ejection roller gear 23 rotates in the direction of the arrow I in FIG. 2 via the intermediate gears 18 through 22 along with the rotation of the feed roller gear 13 in the direction of the arrow F in FIG. 2. The paper supply/ejection roller 25 thereby conveys paper (not shown) in the direction of the arrow C in FIG. 1 by engaging the paper from above.

Also, during the paper ejection operation (the printing operation), as shown in FIGS. 1 and 2, the motor gear 10 mounted on the motor 9 rotates in the direction of the arrow J in FIG. 2 along with the driving of the motor 9, and the feed roller gear 13 rotates in the direction of the arrow K in FIG. 2 via the intermediate gears 11 and 12. The feed roller 2 thereby conveys the paper in the direction of the arrow D in FIG. 1, as shown in FIG. 1. At this time, the pivot arm 14 pivots in the direction of the arrow M in FIG. 2, and the large gear 16*b* of the oscillating gear 16 meshes with the ink sheet winding gear 17. The ink sheet winding member (not shown) for rolling ink sheets (not shown) is rotated accordingly. Also, the thermal head 7 is pivoted in the direction of applying pressure to the ink sheet and the paper (the direction of the arrow B in FIG. 1) as shown in FIG. 1 by the driving of the motor (not shown) provided separately from the motor 9. Printing is thereby performed on the paper.

At this time, the paper supply/ejection roller gear 23 rotates in the direction of the arrow O in FIG. 2 via the intermediate gears 18 through 22, along with the rotation of the feed roller gear 13 in the direction of the arrow K. The paper supply/ejection roller 25 thereby conveys paper in the direction of the arrow D in FIG. 1.

In the present embodiment, as described above, the oscillating gear 16 is provided with a holder 16*c* for holding the inner peripheral surface 15*a* of the coil spring 15 in a state in which the contact is maintained with a pressure applied from the coil spring 15. Furthermore, the pivot arm 14 is provided with a holder 14*c* for holding the outer peripheral surface 15*b* of the coil spring 15 in a state in which the contact is maintained with a pressure applied from the coil spring 15. Therefore, the sliding resistance in the peripheral direction can be created between the inner peripheral surface 15*a* and the outer peripheral surface of the holder 16*c*, and the outer peripheral surface 15*b* of the coil spring 15 and the inner peripheral surface of the holder 14*c*.

Therefore, the oscillating gear 16 is hindered from rotating relative to the oscillating gear support axle 14*a* of the pivot arm 14 due the sliding resistance in the peripheral direction, whereby the pivot arm 14 on which the oscillating gear 16 is mounted can be easily pivoted and the oscillating gear 16 can be rotated as the feed roller gear 13 rotates. Thus, since the pivot arm 14 can be pivoted with the sliding resistance in the peripheral direction, it is possible to prevent the oscillating gear 16 from separating in the axial direction, unlike in the conventional structure wherein the rotation of the oscillating gear 16 is hindered with the thrust-wise (axial) load of the compressed coil spring. There is accordingly no need to provide a retaining washer in the axial direction or to provide a groove for mounting the retaining washer in the axial direction. Thus, the number of components can therefore be proportionately reduced, as can the time required for assembly.

Also, in the present embodiment, the holder 16*c* of the oscillating gear 16 is provided with a convexity having a circular outer peripheral surface that comes into contact with the inner peripheral surface 15*a* of the coil spring 15 with a pressure. The holder 14*c* of the pivot arm 14 is provided with a concavity having a circular inner peripheral surface that comes into contact with the outer peripheral surface 15*b* of the coil spring 15 with a pressure. Therefore, the diameter of the coil spring 15 (inside and outside diameter) increases when the oscillating gear 16 rotates in the direction opposite the winding direction of the coil spring 15 relative to the oscillating gear support axle 14*a* of the pivot arm 14, and the pressure applied to the circular outer peripheral surface of the holder 16*c* of the oscillating gear 16 by the inner peripheral surface 15*a* of the coil spring 15 is reduced. Therefore, the sliding resistance in the peripheral direction between the oscillating gear 16 and the coil spring 15 is reduced when the oscillating gear 16 rotates in the direction opposite the winding direction (dextrorsely) of the coil spring 15 relative to the oscillating gear support axle 14*a* of the pivot arm 14. Accordingly, the oscillating gear 16 can be slid smoothly relative to the coil spring 15.

Conversely, when the oscillating gear 16 rotates in the winding direction (counter-clockwise direction) of the coil spring 15 relative to the oscillating gear support axle 14*a* of the pivot arm 14, the diameter of the coil spring 15 (inside and outside diameter) decreases and the pressure applied to the circular inner peripheral surface of the holder 14*c* of the pivot arm 14 by the outer peripheral surface 15*b* of the coil spring 15 is reduced. Accordingly, the sliding resistance in the peripheral direction between the pivot arm 14 and the coil spring 15 can thereby be reduced when the oscillating gear 16 rotates in the winding direction of the coil spring 15 relative to the oscillating gear support axle 14*a* of the pivot arm 14. Accordingly, the coil spring 15 can slide smoothly relative to the holder 14*c* of the pivot arm 14. As a result, the oscillating gear 16 can also smoothly rotate integrally with the coil spring 15 relative to the oscillating gear support axle 14*a* of the pivot arm 14.

Also, in the present invention, the concavity in the pivot arm 14 is formed into the shape of a groove. Therefore, the sliding resistance in the peripheral direction can be created easily because the outer peripheral surface 15*b* of the coil spring 15 can readily be pressed into the inner peripheral surface of the groove with a pressure being applied by the coil spring 15 to the inner periphery of the groove.

Also, in the present embodiment, when the feed roller gear 13 rotates in the direction of the arrow K as shown in FIG. 2, the oscillating gear 16 meshes with the ink sheet winding gear 17 at a specific rotating position of the pivot arm 14. Accordingly, the ink sheet winding gear 17 can easily be rotated by the oscillating gear 16 only when the feed roller gear 13 rotates in the direction of the arrow K in FIG. 2.

The embodiment currently disclosed should be considered as an example in all respects and not as being restrictive. The range of the present invention is expressed by the patent claims and not by the above descriptions of the embodiment, and further includes meanings equivalent to the range of the patent claims and all variations within this range.

For example, in the above embodiments, a heat transfer printer is given as an example of the image forming apparatus. However, the present invention is not limited thereto, and can be applied to image forming apparatuses other than heat transfer printers as long as such image forming apparatuses have a pivot arm.

Figure 9:
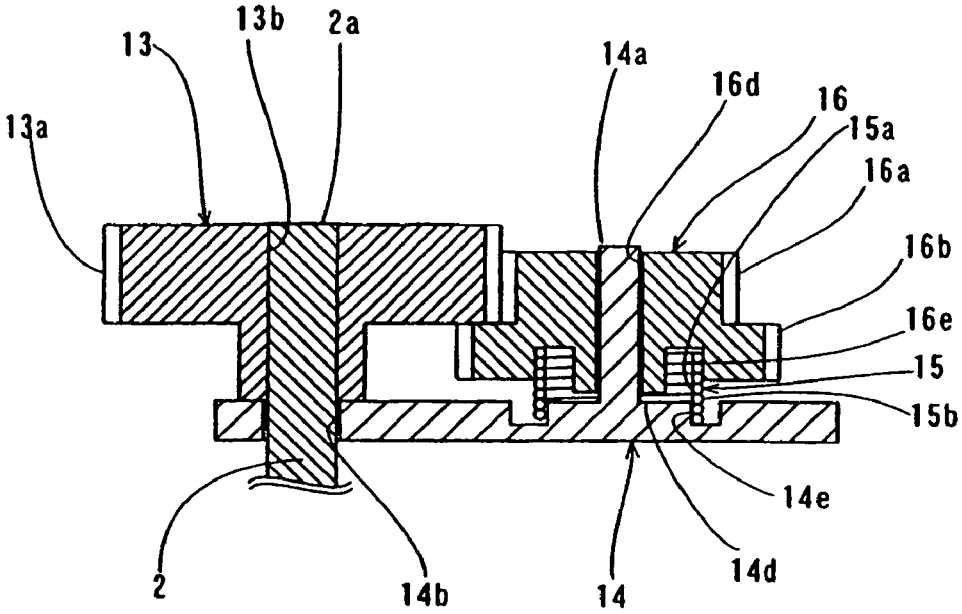
FIG. 9 is a cross-sectional view of the feed roller gear, the oscillating gear, and the pivot arm of the heat transfer printer according to a modification of the first embodiment shown in FIG. 1.
Figure 10:
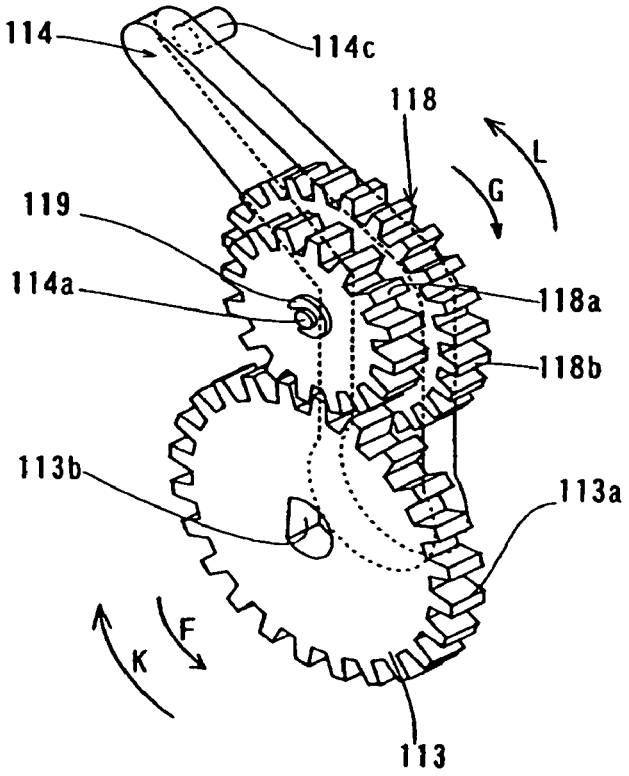
PRIOR ART Figure 10
FIG. 10 is a perspective view of the feed roller gear, the oscillating gear, and the pivot arm of the conventional heat transfer printer.
Figure 11:
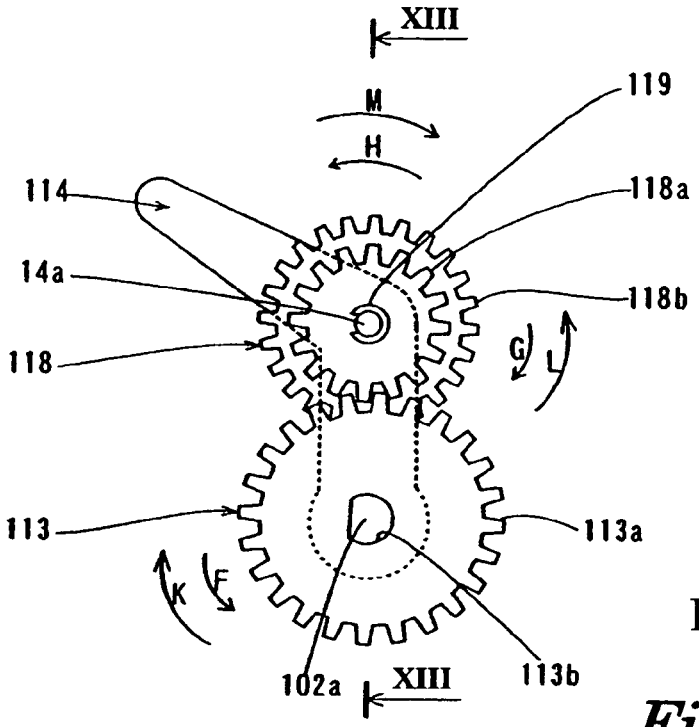
PRIOR ART Figure 11
FIG. 11 is a front view of the feed roller gear, the oscillating gear, and the pivot arm of the conventional heat transfer printer.
Figure 12:
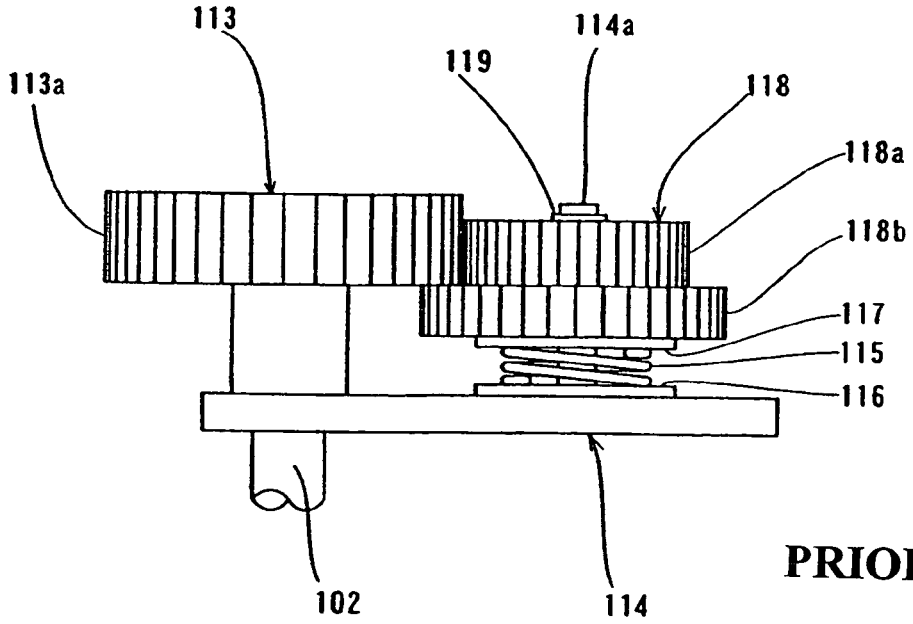
PRIOR ART Figure 12
FIG. 12 is a side view of the feed roller gear, the oscillating gear, and the pivot arm of the conventional heat transfer printer.
Figure 13:
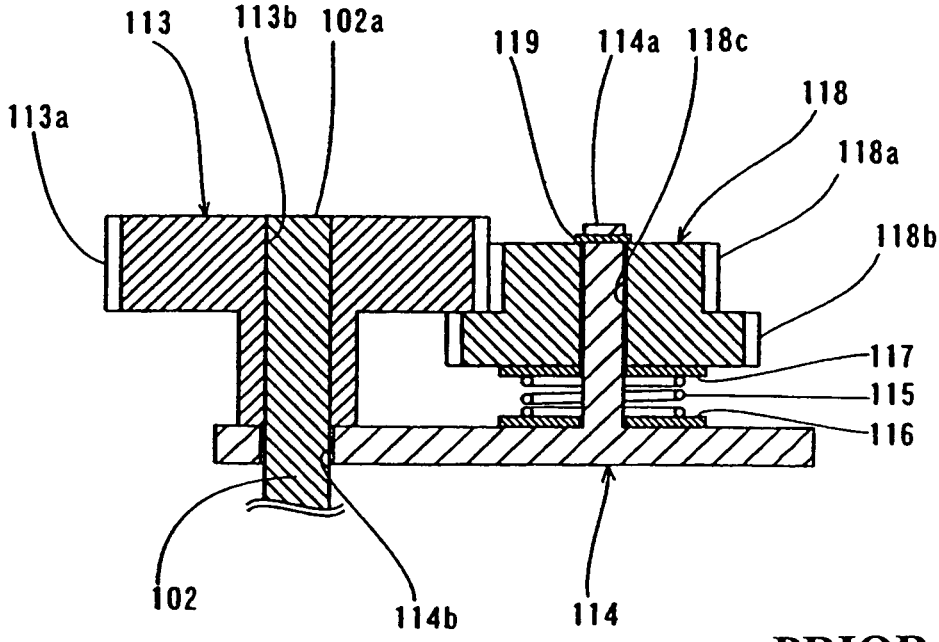
PRIOR ART Figure 13
FIG. 13 is a cross-sectional of the feed roller gear, the oscillating gear, and the pivot arm of the conventional heat transfer printer viewed along the line XIII-XIII in FIG. 11.

Also, in the above embodiments, the inner peripheral surface of the coil spring 15 engages the outer peripheral surface of the holder 16*c* of the oscillating gear 16, while the outer peripheral surface of the coil spring 15 engages the circular inner peripheral surface of the holder 14*c* of the pivot arm 14. However, the present invention is not limited to such construction. Alternatively, as shown in FIG. 9, a circular inner peripheral surface of the holder 16*e* of the oscillating gear 16 may engage the outer peripheral surface of the coil spring 15 in a state in which the contact is maintained with a pressure being applied by the coil spring 15, while a circular outer peripheral surface of the holder 14*e* of the pivot arm 14 may engage the inner peripheral surface of the coil spring 15 in a state in which the contact is maintained with a pressure being applied by the coil spring 15. In this configuration as well, similar to the above embodiments, the oscillating gear 16 can smoothly rotate relative to the oscillating gear support axle 14*a* of the pivot arm 14 regardless of the direction of rotation, while allowing the pivoting of the pivot arm 14 in the rotation direction of the feed roller gear 13.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An image forming apparatus, comprising:

a chassis having a side wall with a slot;

a roller rotatably supported in the chassis;

a motor configured to drive the roller in either of first and second rotational directions;

a motive gear that receives driving force from the motor;

a driven gear that meshes with the motive gear; and a pivot arm that is pivotally mounted on the motive gear and has an axle that rotatably supports the driven gear via a coil spring and a contact element that protrudes towards the side wall of the chassis, the contact element being disposed in the slot to restrict a pivotal movement of the pivot arm within a predetermined amount, one of inner and outer peripheral portions of the coil spring engaging a first holder integrally formed on the driven gear with a biasing force of the coil spring, the other of the inner and outer peripheral portions of the coil spring engaging a second holder formed on the pivot arm with the biasing force of the coil spring.

2. The image forming apparatus according to claim 1, wherein the first holder of the driven gear includes a cylindrical portion with a circular outer peripheral portion that engages the inner peripheral portion of the coil spring, and the second holder of the pivot arm includes a concave portion with a circular inner peripheral portion that engages the outer peripheral portion of the coil spring.

3. The image forming apparatus according to claim 2, wherein the concave portion of the pivot arm has a shape of a groove.

4. The image forming apparatus according to claim 1, further comprising a winding gear, the pivot arm being configured to be pivoted toward the winding gear when the motor drives the roller in the first rotational direction, and the driven gear being configured to mesh with the winding gear when the motive gear rotates in the first rotational direction.

5. The image forming apparatus according to claim 1, wherein the first holder of the driven gear includes a concave portion with a circular inner peripheral portion that engages the outer peripheral portion of the coil spring, and the second holder of the pivot arm includes a cylindrical portion with a circular outer peripheral portion that engages the inner peripheral portion of the coil spring.

6. The image forming apparatus according to claim 1, wherein the roller is a feed roller adapted to convey paper in a paper supply direction when the motor rotates the feed roller in the second rotational direction, and in a paper ejection direction when the motor rotates the feed roller in the first rotational direction.

7. The image forming apparatus according to claim 1, wherein the image forming apparatus is a heat transfer printer.

8. An image forming apparatus, comprising a chassis having a side wall with a slot;

a thermal head pivotally supported in the chassis;

a platen roller rotatably supported in the chassis opposite the thermal head;

a feed roller rotatably supported in the chassis;

a motor configured to drive the feed roller in either of first and second rotational directions;

a motive gear that receives driving force from the motor;

an oscillatable gear that meshes with the motive gear;

a pivot arm that is pivotally mounted on the motive gear and has an axle that rotatably supports the driven gear via a coil spring and a contact element that protrudes towards the side wall of the chassis, the contact element being disposed in the slot to restrict a pivotal movement of the pivot arm within a predetermined amount, an inner peripheral portion of the coil spring engaging an outer peripheral portion of a cylindrical portion of a first holder integrally formed on the oscillatable gear with a biasing force of the coil spring, an outer peripheral portion of the coil spring engaging an inner peripheral portion of a groove-shaped concave portion of a second holder formed on the pivot arm with the biasing force of the coil spring; and a winding gear, the pivot arm being configured to be pivoted toward the winding gear when the motor drives the roller in the first rotational direction, and the oscillatable gear being configured to mesh with the winding gear when the motive gear rotates in the first rotational direction.

* * * * *